US007088936B2

(12) United States Patent
Hirst et al.

(10) Patent No.: US 7,088,936 B2
(45) Date of Patent: Aug. 8, 2006

(54) POWER CONTROL SYSTEM FOR FUSING SYSTEM WITH EXTERNAL HEATER

(75) Inventors: Bartley Mark Hirst, Boise, ID (US); Kenneth Eugene Heath, Boise, ID (US); Mark John Wibbels, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 134 days.

(21) Appl. No.: 10/674,415

(22) Filed: Oct. 1, 2003

(65) Prior Publication Data

US 2005/0074252 A1 Apr. 7, 2005

(51) Int. Cl.
*G03G 15/20* (2006.01)

(52) U.S. Cl. ..... 399/69

(58) Field of Classification Search ..... 399/69, 399/67; 219/216

See application file for complete search history.

(56) References Cited

U.S. PATENT DOCUMENTS 4,977,431 A * 12/1990 Fuji ..... 399/69
6,016,410 A 1/2000 Aslam et al.
6,289,185 B1 9/2001 Cahill
6,304,740 B1 10/2001 Ciaschi et al.
6,411,785 B1 * 6/2002 Ogawahara et al. ..... 399/69
2003/0021611 A1 * 1/2003 Anthony et al. ..... 399/67

FOREIGN PATENT DOCUMENTS

JP 04204858 A * 7/1992
JP 2001175119 A * 6/2001
JP 2003233274 A * 8/2003

* cited by examiner

*Primary Examiner*—Arthur T. Grimley
*Assistant Examiner*—Ryan Gleitz

(57) ABSTRACT

There is provided a fusing system. The fusing system includes a fuser roller, a pressure roller arranged parallel to the fuser roller for providing pressure to a medium passing between the fuser roller and the pressure roller, and a heater external to the fuser roller and applying heat to the fuser roller when the heater is operated to apply heat. The fusing system also includes a control mechanism that the controls the heater to reduce heat provided by the heater when the temperature of the heater is determined to be above a predetermined maximum heater temperature.

32 Claims, 4 Drawing Sheets

POWER CONTROL SYSTEM FOR FUSING SYSTEM WITH EXTERNAL HEATER

BACKGROUND OF THE INVENTION

Reproduction apparatus, such as electrostatographic copier/duplicators, printers or the like often employ a fuser apparatus for forming an image on an image medium. One type of fuser apparatus includes a heated fuser roller and pressure roller system for fusing a developed image on a medium passing between the fuser and pressure roller. Typically, the heated fuser roller is heated using a heater internal to the roller. The pressure roller may or may not be heated.

Fusing systems using an external heater roller for heating a fuser roller are also known. For example, U.S. Pat. Nos. 6,016,410, 6,289,185 and 6,304,740 all disclose a fuser roller, pressure roller and a heating roller external to and in contact with the fuser roller to apply heat to the fuser roller.

DETAILED DESCRIPTION OF EXEMPLARY EMBODIMENTS

Reference will now be made in detail to exemplary embodiments of the present invention. Wherever possible, the same reference numbers will be used throughout the drawings to refer to the same or like parts.

The present inventors have realized that certain problems should be addressed when controlling the temperature of an external heater used in providing heat to a fuser roller of a fuser apparatus employing a fuser roller and pressure roller. Of concern is that when applying heat via an external heater, such as via a heater roller, high temperatures are often applied directly to the outer layers of both the fuser roller and the pressure roller. This can cause delamination of the outer coating of the rollers and cause other damage to the layers of the rollers. Another concern is that hot spots can cause localized damage to the fuser and pressure rollers when the fuser roller is not rotating. Yet another concern is that the energy application to the external heater must be controlled when the fuser roller or pressure roller are at their desired temperatures to avoid overheating these rollers.

In light of the above mentioned concerns, the heating control of the external heater should include control as follows. The external heater should be controlled to limit its maximum temperature. Also the heat applied to the fuser roller should be limited when the fuser roller is not rotating to prevent hot spots. Finally, the external heater should also be controlled to reduce the heat provided therefrom when the temperature of the fuser roller, or possibly the pressure roller, is above its operating temperature. Beneficially, controlling the external heater in this fashion reduces the delamination and roller damage problems mentioned above.

Figure 1:
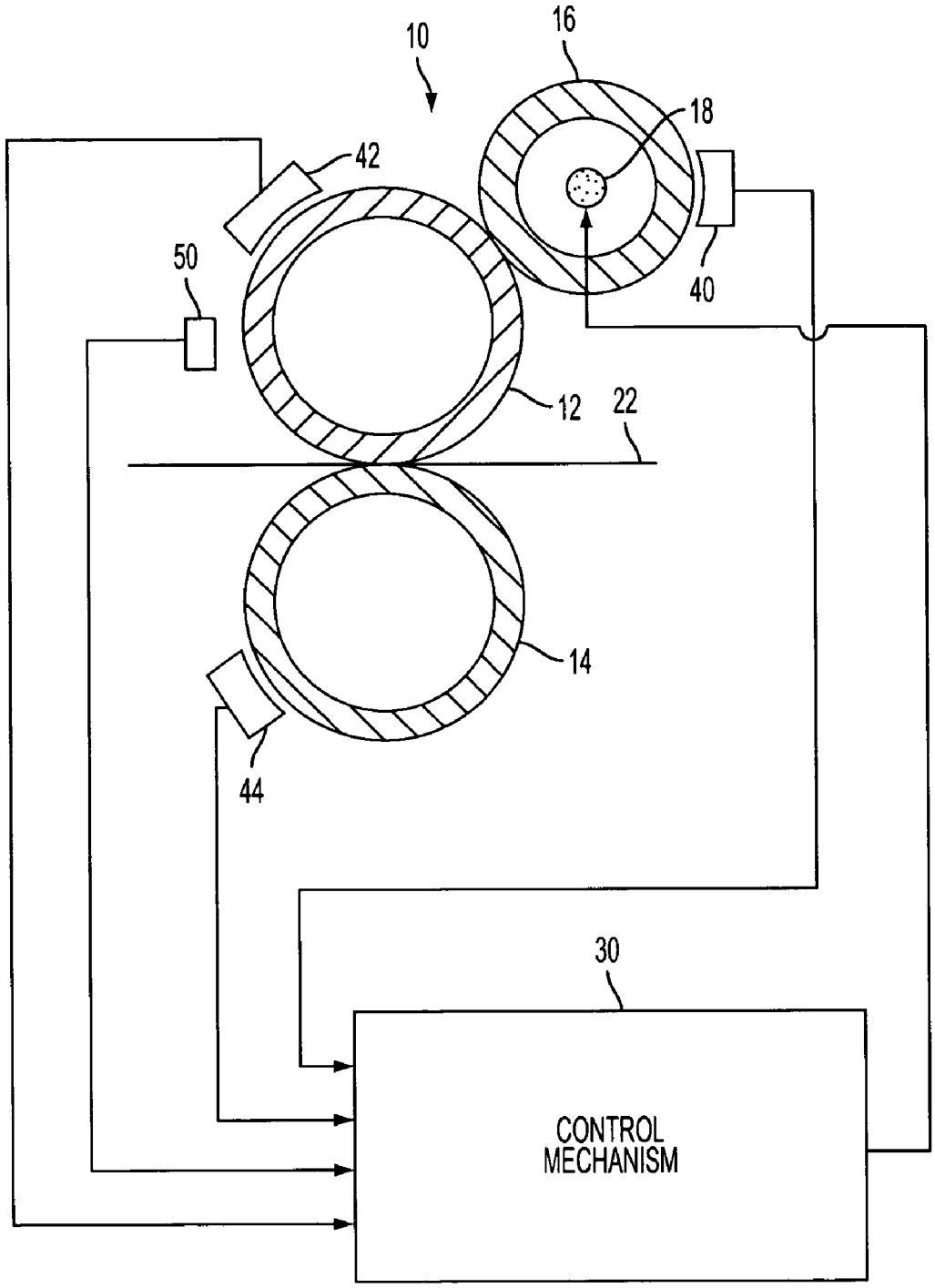
FIG. 1 is a schematic illustrating a fusing system according to an exemplary embodiment of the invention.

FIG. 1 illustrates a fusing system 10 according to an exemplary embodiment of the invention. The fusing system 10 includes a fuser roller 12 in nip relation with a pressure roller 14. Rotation of the fuser roller 12 will serve to transport a medium 22 passing between the fuser roller 12 and the pressure roller 14. The fuser roller may be driven, for example, by a fuser roller motor (not shown). The pressure roller 14 is arranged parallel to the fuser roller 12 in nip relation thereto. When the fuser roller 12 is in operation, the heat from the fuser roller 12 and pressure roller 14 along with the pressure from the pressure roller 14 act to fix an image on the medium 22 as is known in the art. The medium 22 is not part of the fusing system 10, and may be, for example, a sheet of paper or transparency material.

The fusing system also includes a heater 16 external to the fuser roller 12 and applying heat to the fuser roller 12 when the heater 16 is operated. FIG. 1 illustrates the heater 16 to be a heating roller.

Alternatively, the heater 16 may be a lamp or heating coil or some other type of external heating device. When the heater 16 is a heating roller, the heater 16 may also include a heating element 18, such as a tungsten filament quartz halogen lamp or open air coiled wire nichrome alloy heating element, for example.

The heater 16 as arranged in the fusing system 10 illustrated in FIG. 1, applies heat directly to the fuser roller 12, and indirectly to the pressure roller 14 through the contact of the fuser roller 12 with the pressure roller 14. Alternatively, the heater 16 may also directly apply heat to the pressure roller 14.

The fusing system 10 arrangement illustrated in FIG. 1 shows only a single external heater 16. Alternatively, the fuser system 10 may include more than one external heater. The heaters of the more than one external heater may all apply heat directly to the fuser roller 12, or only some external heaters may apply heat directly to the fuser roller 12, while other external heaters apply heat directly to the pressure roller 14. While not shown, the fusing system 10 may include heating elements internal to fuser roller 12 and pressure roller 14 in addition to the external heater 16. These heating elements are typically controlled by an independent temperature control system (not shown).

The fusing system 10 also includes a control mechanism 30 that acts to control the heater 16. Specifically, the control mechanism 30 operates the heater 16 to apply heat to the fuser roller 12. In one example of operating the heater 16 to apply heat to the fuser roller 12, the heater 16 may be operated to be moved toward and to contact the fuser roller 12 when it is desired to heat the fuser roller 12.

In another example of operating the heater 16 to apply heat to the fuser roller 12, the control mechanism 30 may control the power applied to the heater 16 to thereby control the temperature of the heater 16 and the heat provided by the heater 16 to the fuser roller 12. For example, if the heater 16 comprises a heating lamp as the heating element 18, either along or embedded within a heating roller, the control mechanism may control the voltage and power to the heater 16.

As yet another example of operating the heater 16 to apply heat to the fuser roller 12, the heater 16 may be operated to be moved toward and to contact the fuser roller 12 when it is desired to heat the fuser roller 12, and the control mechanism 30 may also control the power applied to the heater 16.

The control mechanism 30 may comprise a circuit for controlling the heater 16, such as the circuit described below in FIG. 3. Alternatively, the control mechanism 30 may comprise a processor programmed to provide control functions to control the heater 16. In this regard the control mechanism 30 may include software for control functions.

Returning to FIG. 1, the fusing system 10 may include a number of temperature sensors for the detecting the temperatures, respectively, of the fuser roller 12, pressure roller 14 and the external heater 16. Specifically, the fusing system 10 may include a heater temperature sensor 40 for detecting the temperature of the heater 16, a fuser roller temperature sensor 42 for detecting the temperature of the fuser roller 12, and a pressure roller temperature sensor 44 for detecting the temperature of the pressure roller 14. The temperature sensors 40, 42 and 44, may be, for example thermistors.

Signals indicative of temperature from the temperature sensors 40, 42 and 44 are input into the control mechanism 30, and based on these signals, the control mechanism acts to control the heater 16. The signals from sensors 42 and 44 may also used by an independent control system (not shown) to control the temperature of the fuser roller 12 and pressure roller 14 by controlling the power to their internal heaters (not shown).

Figure 2A:
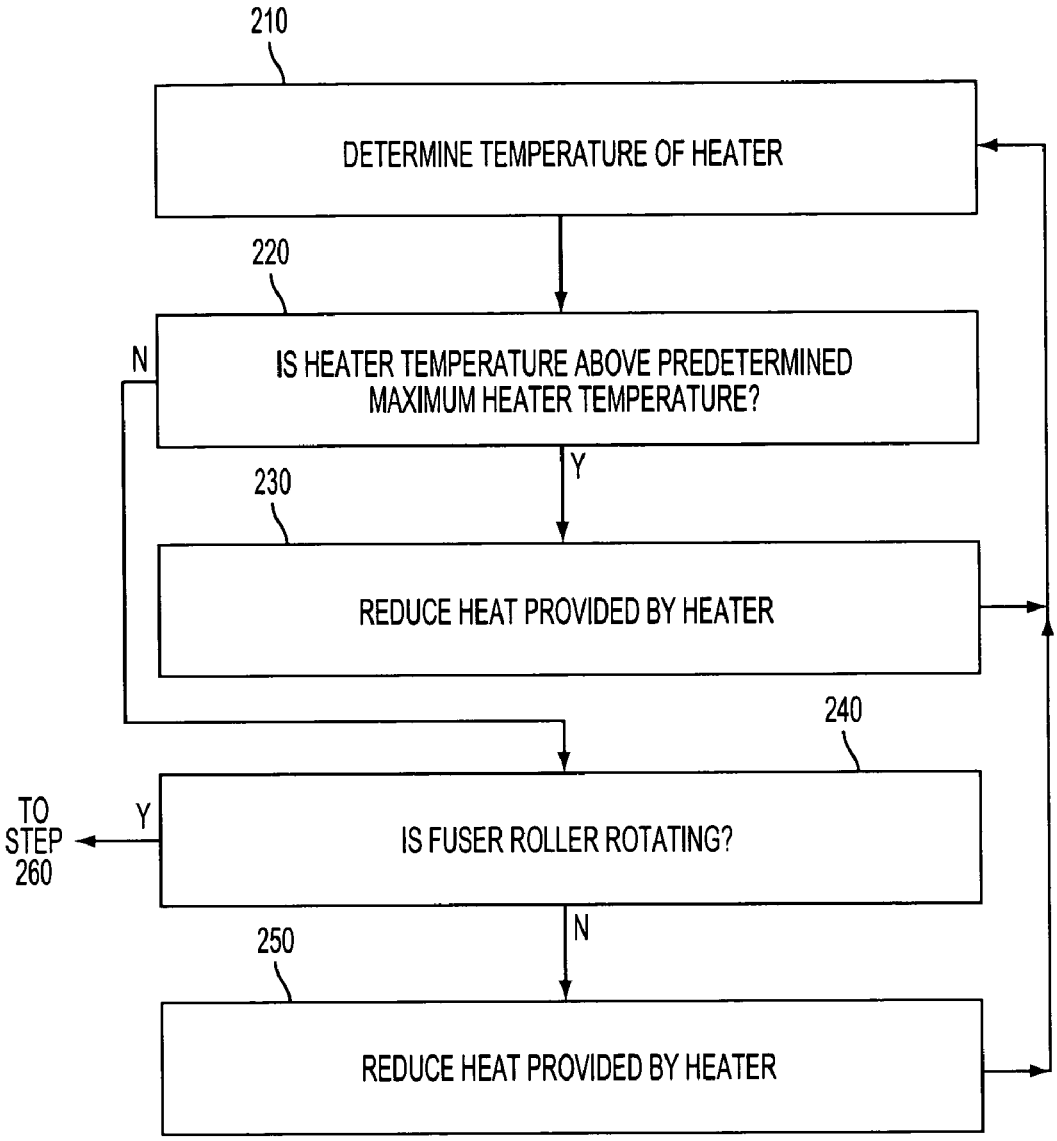
FIGS. 2A and 2B are a flow diagram illustrating a method of controlling temperature for a fusing system according to an exemplary embodiment of the invention.
Figure 2B:
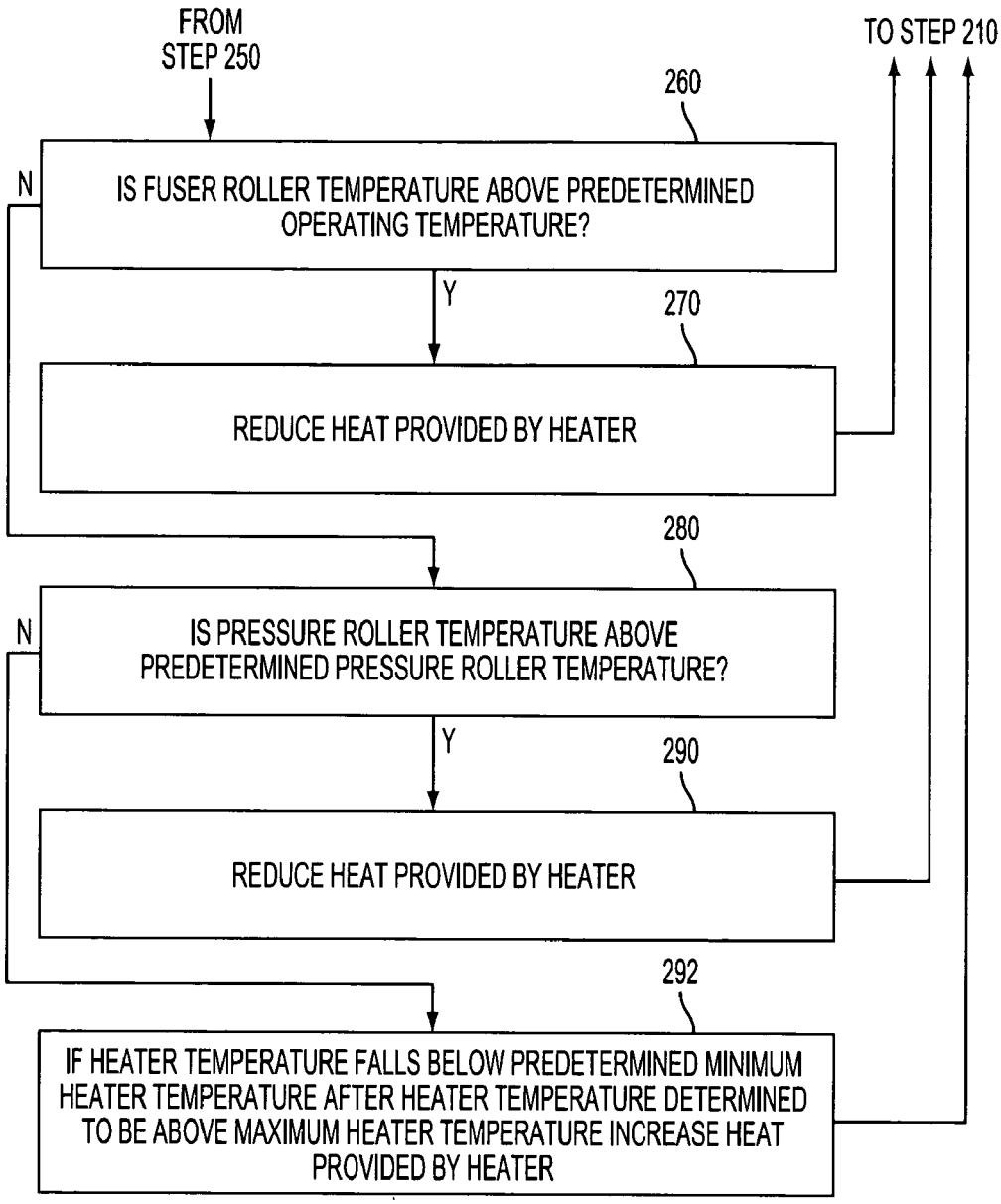

The fusing system 10 may control the heater 16 in the following fashion according to an exemplary embodiment of the invention as illustrated in the flow chart of FIGS. 2A and 2B. In step 210, the temperature of the heater 16 is determined. This step may be performed, for example, using the temperature sensor 40 which detects the temperature of the heater 16. In step 220, it is determined whether or not the temperature of the heater 16 is above a predetermined maximum heater temperature. As an example, the predetermined maximum heater temperature may be about 250° C. The particular maximum heater temperature will depend upon the particular heater roller 16 and the temperature desired for the fusing process.

If the temperature of the heater 16 is determined to be above a predetermined maximum heater temperature, flow passes to step 230. In step 230 the heater 16 is operated to reduce the heat provided by the heater 16 to the fuser roller 12. This may be accomplished, for example, by controlling the heater 16 to reduce its temperature. For example, the voltage and power applied to the heater 16 may be reduced. Flow is then passed to step 210.

If the temperature of the heater 16 is determined to be below a predetermined maximum heater temperature, step 240 is performed. In step 240, it is determined whether or not the fuser roller 12 is rotating. For example, if the fuser roller 12 rotates by means of a motor (not shown) either directly or indirectly, it may be determined whether or not the motor is operating to drive the fuser roller 12. As another alternative, a rotation sensor 50 may detect whether or not the fuser roller 12 is rotating.

If the fuser roller 12 is determined to not be rotating, flow passes to step 250. In step 250, the heater 16 is operated to reduce the heat provided by the heater 16 to the fuser roller 12. This may be accomplished, for example, by controlling the heater 16 to reduce its temperature. For example, the voltage and power applied to the heater 16 may be reduced. Flow is then passed to step 210.

If the fuser roller 12 is determined to be rotating, flow passes to step 260. In step 260 it is determined whether or not the temperature of the fuser roller 12 is above a predetermined operating temperature. As an example, the predetermined operating temperature may be about 180° C. The particular predetermined operating temperature will depend upon the fuser roller 12 and the temperature desired for the fusing process.

If the temperature of the fuser roller 12 is determined to be above a predetermined operating temperature flow passes to step 270. In step 270, the heater 16 is operated to reduce the heat provided by the heater 16 to the fuser roller 12. This may be accomplished, for example, by controlling the heater 16 to reduce its temperature. For example, the voltage and power applied to the heater 16 may be reduced. Flow is then passed to step 210.

If the temperature of the fuser roller 12 is determined to not be above a predetermined operating temperature, flow may be passed to step 280.

In step 280 it is determined whether or not the temperature of the pressure roller 14 is above a predetermined pressure roller temperature. As an example, the predetermined pressure roller temperature may be about 180° C. The particular predetermined pressure roller temperature will depend upon the pressure roller 14 and the temperature desired for the fusing process.

If the temperature of the pressure roller 14 is determined to be above a predetermined pressure roller temperature, flow passes to step 290. In step 290, the heater 16 is operated to reduce the heat provided by the heater 16, either directly, or indirectly via the fuser roller 12, to the pressure roller 14. This may be accomplished, for example, by controlling the heater 16 to reduce its temperature. For example, the voltage applied to the heater 16 may be reduced. Flow is then passed to step 210.

If the temperature of the pressure roller 14 is determined to not be above a predetermined pressure roller temperature, flow is passed to step 292. In step 292, if the heater temperature falls below the predetermined target heater temperature after the heater temperature has been determined to be above the predetermined maximum heater temperature, the heater is operated to increase the heat provided, such as by increasing the power to the heater 16. Thus, if the heater had been controlled earlier to reduce its heat because its temperature had risen beyond the predetermined maximum heater temperature, and subsequently the temperature of the heater 16 falls below the predetermined target temperature, the heat from the heater 16 is again increased. Flow then moves to step 210.

Figure 3:
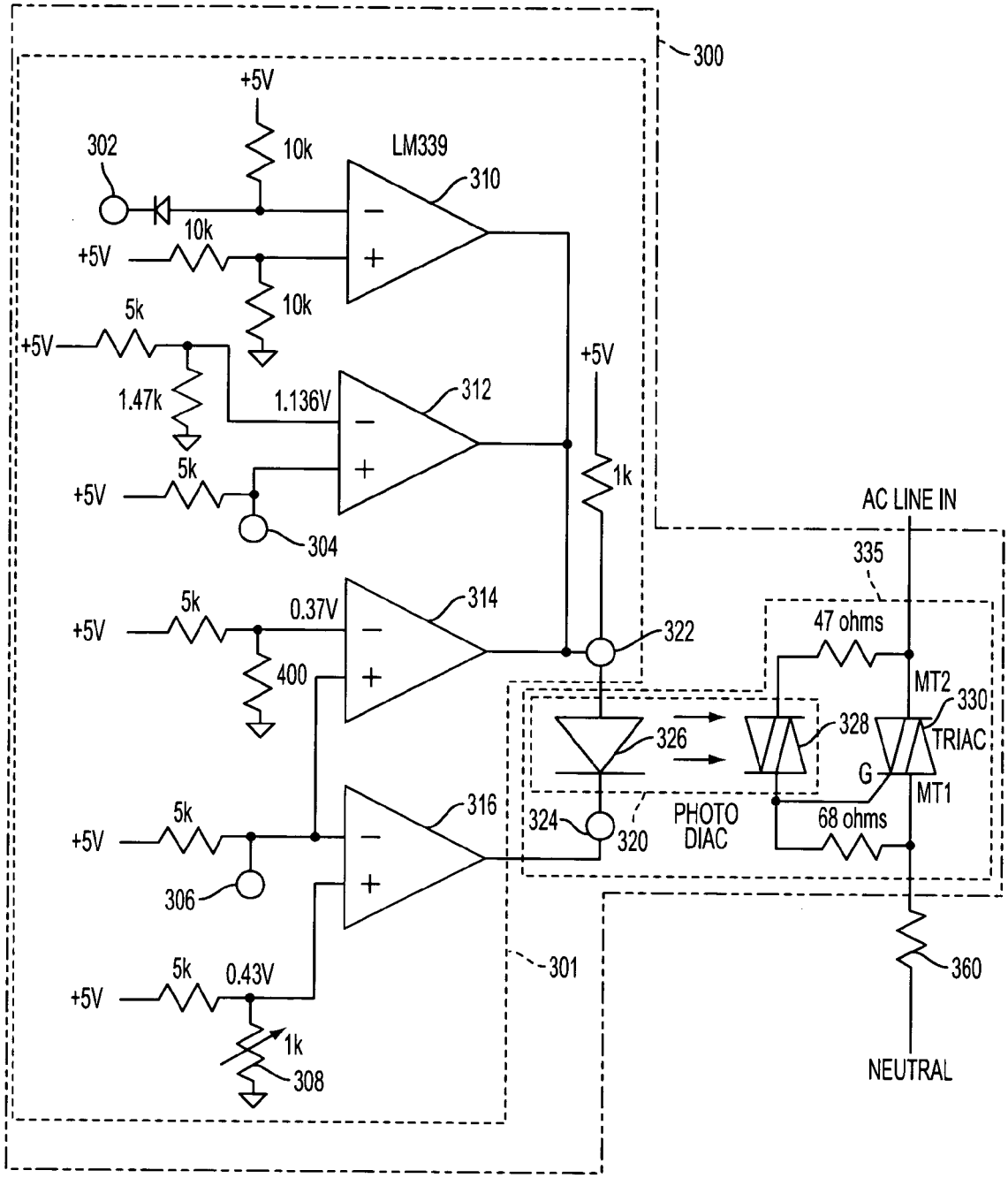
FIG. 3 is a circuit diagram illustrating a control circuit of a fusing system according to an exemplary embodiment of the invention.

FIG. 3 is an exemplary embodiment of a control circuit 300 for acting as the control mechanism 30 of the fusing system of FIG. 1. The control circuit 300 comprises the elements within the dotted lines in FIG. 1. The elements outside the dashed lines interact with the control circuit 300, but are not part of it.

FIG. 3 illustrates an embodiment of a control circuit 300 in the instance where the heater 16 is controlled such that power to the heater 16 is cut off when (1) the fuser roller 12 is determined to not be rotating, (2) the fuser roller temperature is determined to be above a predetermined operating temperature, or (3) the heater temperature is above a predetermined maximum heater temperature.

The control circuit 300 include a comparison portion 301 that determines: (1) whether or not the fuser roller 12 is rotating, (2) whether or not the fuser roller temperature is above a predetermined operating temperature, (3) whether or not the heater temperature is above a predetermined maximum heater temperature, and (4) whether or not the heater temperature is below a predetermined target heater temperature.

In making these determinations, the comparison portion 301 includes a number of inputs 302, 304, 306, for respectively a signal indicative of the fuser roller rotation, the fuser roller temperature, and the heater temperature. The signal indicative of the fuser roller rotation may be, for example, a voltage indicating that a motor for driving the fuser motor is on, for example, or a signal from a rotation sensor. The signal indicative of the temperature of the fuser roller 12 may be from a thermistor adjacent to the fuser roller 12, for example. The signal indicative of the temperature of the heater 16 may be from a thermistor adjacent to the heater 16, for example.

The comparison portion 301 also includes a number of comparators 310, 312, 314, and 316 for comparing the signals indicative of the fuser roller rotation, fuser roller temperature, and heater temperature to set values in determining, respectively: (1) whether or not the fuser roller 12 is rotating, (2) whether or not the fuser roller temperature is above a predetermined operating temperature, (3) whether or not the heater temperature is above a predetermined maximum heater temperature, and (4) whether or not the heater temperature is below a predetermined target heater temperature.

The comparators function as follows. Comparator 310 compares the signal indicative of whether the fuser roller is rotating with a set signal and if the signal indicative of the fuser roller rotation indicates that the fuser roller is not rotating, outputs a voltage signal indicating that the heater 16 should be shut off. Comparator 312 compares the signal indicative of the temperature of the fuser roller with a set signal, which is indicative of the predetermined operating temperature, and if the signal indicative of the temperature of the fuser roller indicates that the fuser roller temperature is above the predetermined operating temperature, outputs a voltage signal indicating that the heater should be shut off.

Similarly, comparator 314 compares the signal indicative of the temperature of the heater 16 with a set signal, which is indicative of the predetermined maximum heater temperature, and if the signal indicative of the temperature of the heater indicates that the heater temperature is above the predetermined maximum heater temperature, outputs a voltage signal indicating that the heater should be shut off. Comparator 316 compares the signal indicative of the temperature of the heater with a set signal, which is indicative of the predetermined heater target temperature, and if signal indicative of the temperature of the heater indicates that the heater temperature is below the predetermined heater target temperature outputs a voltage signal indicating that the heater should be on. Variable resistor 308 sets the heater target temperature.

The circuit 300 also includes a photo diac 320 that in combination with triac 330 acts as a switch 335 to connect to an AC line, with heater lamp 360 of the heater 316 to provide power to the heater lamp 360. The photo diac 320 acts to isolate the higher AC line voltage and power from the lower voltages from the comparison section 301. The photo diac 320 includes a photodiode 326 that provides a light signal to a triac 328 of the photodiac 320.

The photo diac 320 operates based on the voltage signals output from the comparator outputs. Comparator outputs of comparators 310, 312, and 314 are arranged as shown in FIG. 3 connected to a first terminal 322 of photo diac 320, and the output of comparator 316 is arranged connected to a second terminal 324 of the photo diac 320. If the output signal from any one of the comparators 310, 312, and 314 is a voltage signal indicating that the heater should be off, the photodiac 320 in conjunction with the triac 330 acts to prevent the AC line power from reaching the heater lamp 360, regardless of the output signal from the comparator 316. On the other hand if the output signal from all of the comparators 310, 312 and 314 is not a voltage signal indicating that the heater should be off and the output from the comparator 316 is a voltage signal indicating that the heater should be on, the photo diac 320 and triac 330 act to allow the AC line power to reach the heater lamp 360, and thus the heater 16, is operated to provide heat.

While some of the electronic components in FIG. 3 are shown to have specific values, the invention is not so limited. The actual values of the electronic components will depend on the specific implementation, and particular predetermined maximum heater temperature, predetermined maximum heater temperature, and predetermined operation temperature desired.

It should be noted that although the flow charts provided herein show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the invention.

While the invention has been described in detail and with reference to specific embodiments thereof, it will be apparent to one skilled in the art that various changes and modifications can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A fusing system comprising:

a fuser roller;

a pressure roller arranged parallel to the fuser roller for providing pressure to a medium passing between the fuser roller and the pressure roller;

a heater external to the fuser roller and applying heat to the fuser roller when the heater is operated to apply heat; and a control mechanism that controls the heater to:

reduce heat provided by the heater, by decreasing a voltage and power that remains positive while being applied to the heater, when a temperature of the heater is determined to be above a predetermined temperature, a temperature of the fuser roller is determined to be above a predetermined temperature, and a temperature of the pressure roller is determined to be above a predetermined temperature.

2. The fusing system of claim 1, wherein the predetermined temperature for the heater is a maximum heater temperature of about 250° C.

3. The fusing system of claim 1, wherein the control mechanism, after reducing heat provided by the heater, by decreasing the voltage and power applied to the heater, when the temperature of the heater is determined to be above a predetermined maximum heater temperature, controls the heater to increase heat provided by the heater, by increasing the voltage and power applied to the heater from a level of the decreased voltage and power, when the temperature of the heater is determined to fall below a predetermined target heater temperature.

4. The fusing system of claim 1, further comprising:

a heater temperature sensor that detects the temperature of the heater, and wherein the temperature of the heater is determined to be above a predetermined maximum heater temperature based on the temperature detection of the heater temperature sensor.

5. The fusing system of claim 1, wherein the heater temperature sensor is a thermistor.

6. The fusing system of claim 1, wherein the control mechanism controls the heater to reduce the heat provided by the heater when the fuser roller is determined to not be rotating.

7. The fusing system of claim 6, further comprising:

a rotation sensor that detects the rotation of the fuser roller, and wherein the temperature of the heater is reduced when the fuser roller is determined to not be rotating based on the detection by the rotation sensor.

8. The fusing system of claim 1, wherein the predetermined temperature of the fuser roller is about 180° C.

9. The fusing system of claim 1, further comprising:

a fuser roller temperature sensor that detects the temperature of the fuser roller, and wherein the temperature of the fuser roller is determined to be above a predetermined operating temperature based on the temperature detection of the fuser roller temperature sensor.

10. The fusing system of claim 9, wherein the fuser roller temperature sensor comprises a thermistor.

11. The fusing system of claim 1, wherein the control mechanism controls the heater to reduce the heat provided by the heater when the temperature of the pressure roller is determined to be above a predetermined pressure roller temperature.

12. The fusing system of claim 1, further comprising:

a pressure roller temperature sensor that detects the temperature of the pressure roller, and wherein the temperature of the pressure roller is determined to be above a predetermined pressure roller temperature based on the temperature detection of the pressure roller temperature sensor.

13. The fusing system of claim 12, wherein the pressure roller temperature sensor comprises a thermistor.

14. The fusing system of claim 1, wherein the heater is a heating roller operable to contact the fuser roller.

15. The fusing system of claim 1, wherein the control mechanism comprises a processor programmed to provide control functions.

16. The fusing system of claim 1, wherein the control mechanism comprises a control circuit.

17. The fusing system of claim 16, wherein the control circuit comprises:

a switch controlling power to a heater lamp of the heater; and a comparison circuit which is configured to receive an input signal indicative of the temperature of the heater and to provide an output causing the switch to prevent power to the heater lamp when the input signal indicative of the temperature of the heater indicates that the temperature of the heater is above a predetermined maximum heater temperature.

18. The fusing system of claim 17, wherein the comparison circuit is further configured to receive an input signal indicative of the temperature of the fuser roller and to provide an output causing the switch to prevent power to the heater lamp when the input signal indicative of the temperature of the fuser roller indicates that the temperature of the fuser roller is above a predetermined operating temperature.

19. The fusing system of claim 17, wherein the comparison circuit is further configured to receive an input signal indicative of the rotation of the fuser roller and to provide an output causing the switch to prevent power to the heater lamp when the input signal indicative of the rotation of the fuser roller indicates that the fuser roller is not rotating.

20. The fusing system of claim 17, wherein the comparison circuit comprises a plurality of comparators having outputs connected to inputs of the switch.

21. The fusing system of claim 20, wherein the switch comprises a photo diac coupled with a triac.

22. A method of controlling temperature for a fusing system comprising a fuser roller, a pressure roller arranged parallel to the fuser roller for providing pressure to a medium passing between the fuser roller and the pressure roller, and a heater external to the fuser roller and applying heat to the fuser roller when the heater is operated to apply heat, the method comprising:

reducing heat provided by the heater, by decreasing a voltage and power that remains positive while being applied to the heater, when a temperature of the heater is determined to be above a predetermined temperature, a temperature of the fuser roller is determined to be above a predetermined temperature, and a temperature of the pressure roller is determined to be above a predetermined temperature.

23. The method of claim 22, wherein the predetermined temperature for the heater is a maximum heater temperature of about 250° C.

24. The method of claim 22, further comprising:

increasing heat provided by the heater, by increasing the voltage and power applied to the heater from a level of the decreased voltage and power, when the temperature of the heater is determined to fall below a predetermined target heater temperature after reducing heat provided by the heater, by decreasing the voltage and power applied to the heater, when the temperature of the heater is determined to be above a predetermined maximum heater temperature.

25. The method of claim 22, wherein when the temperature of the heater is determined to be above a predetermined maximum heater temperature, the heater is operated not to apply heat.

26. The method of claim 22, further comprising:

reducing the heat provided by the heater when the fuser roller is determined to not be rotating.

27. The method of claim 26, wherein when the fuser roller is determined to not be rotating, the heater is operated not to apply heat.

28. The method of claim 22, further comprising:

reducing the heat provided by the heater when the temperature of the fuser roller is determined to be above a predetermined operating temperature.

29. The method of claim 28, wherein the predetermined operating temperature is about 180° C.

30. The method of claim 28, wherein when the temperature of the fuser roller is determined to be above a predetermined operating temperature, the heater is operated not to apply heat.

31. The method of claim 22, further comprising:

reducing the heat provided by the heater when the temperature of the pressure roller is determined to be above a predetermined pressure roller temperature.

32. The method of claim 31, wherein when the temperature of the pressure roller is determined to be above a predetermined pressure roller temperature, the heater is operated not to apply heat.

* * * * *